US010961479B2

(12) United States Patent
Kawamoto et al.

(10) Patent No.: US 10,961,479 B2
(45) Date of Patent: Mar. 30, 2021

(54) LUBRICATING OIL COMPOSITION

(71) Applicant: NOF CORPORATION, Tokyo (JP)

(72) Inventors: Hideki Kawamoto, Amagasaki (JP); Shunsuke Monjiyama, Amagasaki (JP)

(73) Assignee: NOF CORPORATION, Tokyo (JP)

( * ) Notice: Subject to any disclaimer, the term of this patent is extended or adjusted under 35 U.S.C. 154(b) by 182 days.

(21) Appl. No.: 16/309,583

(22) PCT Filed: Jun. 7, 2017

(86) PCT No.: PCT/JP2017/021120
§ 371 (c)(1),
(2) Date: Dec. 13, 2018

(87) PCT Pub. No.: WO2017/217299
PCT Pub. Date: Dec. 21, 2017

(65) Prior Publication Data

US 2020/0308502 A1 Oct. 1, 2020

(30) Foreign Application Priority Data

Jun. 14, 2016 (JP) ..... JP2016-117728

(51) Int. Cl.

| | |
|---|---|
| ***C10M 105/42*** | (2006.01) |
| ***C10M 129/76*** | (2006.01) |
| ***C10M 137/08*** | (2006.01) |
| ***C10M 169/04*** | (2006.01) |
| *C10N 30/00* | (2006.01) |
| *C10N 20/00* | (2006.01) |
| *C10N 20/02* | (2006.01) |
| *C10N 30/06* | (2006.01) |
| *C10N 30/10* | (2006.01) |
| *C10N 30/12* | (2006.01) |
| *C10N 40/02* | (2006.01) |
| *C10N 40/04* | (2006.01) |
| *C10N 40/08* | (2006.01) |

(52) U.S. Cl.
CPC ..... *C10M 105/42* (2013.01); *C10M 129/76* (2013.01); *C10M 137/08* (2013.01); *C10M 169/04* (2013.01); *C10M 2207/289* (2013.01); *C10M 2207/301* (2013.01); *C10M 2223/043* (2013.01); *C10N 2020/02* (2013.01); *C10N 2020/081* (2020.05); *C10N 2030/06* (2013.01); *C10N 2030/10* (2013.01); *C10N 2030/12* (2013.01); *C10N 2030/64* (2020.05); *C10N 2040/02* (2013.01); *C10N 2040/04* (2013.01); *C10N 2040/08* (2013.01)

(58) Field of Classification Search
CPC ..... C10M 2207/28; C10M 2207/30; C10M 2207/2805; C10M 2223/043; C10M 2207/123; C10N 2060/06
See application file for complete search history.

(56) References Cited

U.S. PATENT DOCUMENTS

| | | | | |
|---|---|---|---|---|
| 3,778,454 | A * | 12/1973 | Kleinman et al. | C07C 69/44 554/227 |
| 5,021,179 | A * | 6/1991 | Zehler | C10M 105/38 252/68 |
| 2014/0296117 | A1* | 10/2014 | Ohno | C10M 105/42 508/439 |
| 2014/0314351 | A1* | 10/2014 | Fujiura | C10M 105/38 384/120 |
| 2015/0166923 | A1* | 6/2015 | Kiko | C10M 141/10 508/282 |
| 2017/0002291 | A1* | 1/2017 | Takahashi | C09K 5/045 |

FOREIGN PATENT DOCUMENTS

| | | | |
|---|---|---|---|
| CN | 103781888 | A | 5/2014 |
| JP | 2000-063875 | A | 2/2000 |
| JP | 2006-265345 | A | 10/2006 |
| JP | 2012-102235 | A | 5/2012 |
| JP | 2015-147859 | A | 8/2015 |

OTHER PUBLICATIONS

International Search Report of PCT/JP2017/021120 dated Jul. 11, 2017.
Communication dated Jan. 13, 2021, issued by the Chinese Patent Office in Chinese application No. 201780036815.7.

* cited by examiner

*Primary Examiner* — Vishal V Vasisth
(74) *Attorney, Agent, or Firm* — Sughrue Mion, PLLC

(57) ABSTRACT

A lubricating oil composition including 100 mass parts of (A) an ester compound, 0.05 to 1.5 mass parts of (B) an amine salt of an acidic phosphoric ester and 0.01 to 0.50 mass parts of (C) a monoesterified compound, wherein (A) the ester compound is an ester compound of trimethylolpropane, a straight-chain saturated fatty acid having a carbon number of 8 to 10 and adipic acid; (B) the amine salt is an amine salt of an acidic phosphoric ester; and (C) the monoesterified compound is a monoesterified compound of an alkane diol having a carbon number of 3 to 8 and of succinic acid having an alkyl group having a carbon number of 8 to 18 or an alkenyl group having a carbon number of 8 to 18.

12 Claims, No Drawings

LUBRICATING OIL COMPOSITION

CROSS REFERENCE TO RELATED APPLICATIONS

This application is a National Stage of International Application No. PCT/JP2017/021120 filed Jun. 7, 2017, claiming priority based on Japanese Patent Application No. 2016-117728 filed Jun. 14, 2016.

TECHNICAL FIELD

The present invention relates to a lubricating oil composition having high biodegradability, excellent rust-prevention performance, as well as high oxidation stability and excellent lubricating property (wear resistance). The lubricating oil composition of the present invention may be preferably used for a bearing oil, hydraulic oil, gear oil or the like.

BACKGROUND ARTS

Recently, it is demanded new trials for environmental preservation as important mission worldwide. Such mission is also demanded in the field of a lubricant oil, and it is further demanded a lubricant oil capable of reducing environmental load more than ever. As a lubricant oil capable of reducing the environmental load, a biodegradable lubricant oil draws attention, as the lubricant oil is susceptible to decomposition in natural world to reduce its effects on ecosystem even in the case that the lubricant oil is leaked out.

Many of biodegradable lubricant oils are used as a countermeasure in the case of leakage into rivers and oceans. Its use is mandatory in some regions and applications. For example, in European countries, the use of the biodegradable lubricant oil is mandated in 2-cycle engine oil in an outboard motor for use in lakes regions, hydraulic oil for construction machinery used near a river for taking drinking water, or the like. In the United States, the use of the biodegradable lubricant oil is mandated in a lubricant oil used in wetted parts of a ship or the like Various kinds of studies have been performed as to the biodegradable lubricant oil. For example, according to patent document 1, it is disclosed a 2-cycle engine oil composed of polybutene, a polyol ester, a paraffin-based hydrocarbon solvent and an ashless detergent. According to patent document 2, it is disclosed a hydraulic oil, which is composed of a complex ester of a polyvalent alcohol, a straight-chain saturated fatty acid and a straight-chain saturated polycarboxylic acid, an antioxidant and a load-bearing additive and excellent in biodegradability, oxidation stability, wear resistance and low-temperature fluidity. According to patent document 3, it is disclosed a stern tube bearing oil, which is composed of a water-soluble (poly)alkylene glycol, a water-soluble thickener and a water-soluble rust-prevention agent and excellent in compatibility with sea water, lubricating property and biodegradability.

BACKGROUND DOCUMENTS

Patent Documents (Patent document 1) Japanese patent publication No. 2000-063875A (Patent document 2) Japanese patent publication No. 2015-147859A (Patent document 3) Japanese patent publication No. 2006-265345A

SUMMARY OF THE INVENTION

Further, a biodegradable lubricant oil is frequently used at locations near water such as rivers and oceans as described above. The lubricant oil is thus susceptible to contamination by water, so that it is necessary to sufficiently consider the prevention of metal corrosion. Particularly in the applications listed above such as a stern bearing oil for use in an lubricant oil for a ship, the oil may be contaminated by sea water. It is thereby required very high rust-prevention performance against sea water. Such requirement has not been sufficiently studied in the background arts as described above, and it is thus required a biodegradable lubricant oil having excellent rust-prevention performance.

An object of the present invention is to provide a lubricating oil composition having excellent biodegradability, high biodegradability, excellent rust-prevention performance, as well as high oxidation stability and excellent lubricating property (wear resistance).

The inventors intensively studied for solving the objects described above. It is then found that a specific lubricating oil composition including an ester compound (A) of trimethylolpropane, of a specific straight-chain saturated fatty acid having a carbon number of 8 to 10 and of adipic acid, (B) a specific amine salt of an acidic phosphoric ester and (C) a specific monoesterified compound of succinic acid has good biodegradability as well as excellent rust-prevention performance, high oxidation stability and excellent lubricating property (wear resistance).

That is, the present invention provides a lubricating oil composition comprising:

100 mass parts of (A) an ester compound described below;

0.05 to 1.5 mass parts of (B) an amine salt of an acidic phosphoric ester described below; and 0.01 to 0.50 mass parts of (C) a monoesterified compound described below.

(A) the ester compound of trimethylolpropane, a straight-chain saturated fatty acid having a carbon number of 8 to 10 and adipic acid. The ester compound satisfying the relationship of $TMP_{mol\ \%}$:$FA_{mol\ \%}$:$AD_{mol\ \%}$ of 20 to 40%:40 to 70%:5 to 25%, respectively, provided that $TMP_{mol\ \%}$ is assigned to a molar percentage of a component derived from trimethylolpropane, $FA_{mol\ \%}$ is assigned to a molar percentage of a component derived from the straight-chain saturated fatty acid having a carbon number of 8 to 10, and $AD_{mol\ \%}$ is assigned to a molar percentage of adipic acid (B) the amine salt of the acidic phosphoric ester represented by the following formula (1)

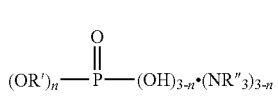

$$(OR')_n-\overset{\overset{\displaystyle O}{\|}}{P}-(OH)_{3-n}\bullet(NR''_3)_{3-n} \quad (1)$$

(n represents an integer of 1 or 2,

R' represents an alkyl group having a carbon number of 4 to 6, and

R" represents hydrogen atom or an alkyl group having a carbon number of 11 to 14.)

(C) the monoesterified compound of an alkane diol having a carbon number of 3 to 8 and of succinic acid having an alkyl group having a carbon number of 8 to 18 or an alkenyl group having a carbon number of 8 to 18

The lubricating oil composition of the present invention has high biodegradability, excellent rust-prevention performance, as well as high oxidation stability and excellent lubricating property (wear resistance). The oil composition may preferably be used for a bearing oil, hydraulic oil, gear oil or the like.

MODES FOR CARRYING OUT THE INVENTION

The lubricant base oil and lubricating oil composition of the present invention will be described below. Further, in the specification, a numerical range defined by a symbol "-" means a numerical range including numerical values at both ends (the highest value and lower value" of "-". For example, "2-5" means a value not lower than 2 and not higher than 5.

The present invention provides a lubricating oil composition including:

100 mass parts of (A) an ester compound described below;

0.05 to 1.5 mass parts of (B) an amine salt of an acidic phosphoric ester; and 0.01 to 0.50 mass parts of (C) a monoesterified compound.

The ester compound (A) of the present invention is an ester compound of trimethylolpropane, a straight-chain saturated fatty acid having a carbon number of 8 to 10 and adipic acid.

Trimethylolpropane is used as a raw material of the ester compound (A). As trimethylolpropane has a neopentyl bone structure, excellent oxidation stability and thermal resistance are obtained, and the thus synthesized complex ester is excellent in low-temperature fluidity. As polyvalent alcohols each having neopentyl bone structure, neopentyl glycol, pentaerythritol or the like may be listed. In the case that neopentyl glycol is used as the raw material, however, the polarity of the thus obtained complex ester is increased, so that the effects of the additives may be deteriorated. Further, in the case that pentaerythritol is used as the raw material, the pour point of the ester tends to be higher so that it is not suitable for use at a low temperature. Trimethylolpropane is preferred in the present invention.

As the monovalent saturated fatty acid used as fatty acid for the raw material of the ester compound (A) in the present invention includes caprylic acid having a carbon number of 8, pelargonic acid having a carbon number of 9 and capric acid having a carbon number of 10. In the case that it is used a straight-chain saturated fatty acid having a carbon number less than 8, the polarity of the thus obtained ester is high so that the effects of the additives to be blended may be insufficient and, for example, the lubricating property (wear resistance) may not be excellent, for example. Further, in the case that it is used a monovalent straight-chain rated fatty acid having a carbon number exceeding 10 as the raw material, the low-temperature fluidity of the thus obtained ester may be deteriorated. Thus, according to the present invention, it is used caprylic acid having a carbon number of 8, pelargonic acid having a carbon number of 9 or capric acid having a carbon number of 10. A single kind of the ester compound may be used alone or two or more kinds of the additives may be used in combination. According to the present invention, it may be most preferably used combination of caprylic acid and capric acid.

As the raw material of the ester compound (A), adipic acid is used as a diprotic acid. In the case that it is used succinic acid or the like whose carbon number is less than that of adipic acid, the polarity of the thus obtained ester may be high and the effects of the additives to be blended may not be sufficiently attained. On the other hand, in the case that it is used dimer acid whose carbon number is larger than that of adipic acid or maleic acid containing a double bond, the oxidation stability and thermal resistance may be deteriorated.

The ester compound (A) satisfies the requirements: $TMP_{mol\ \%}$:$FA_{mol\ \%}$:$AD_{mol\ \%}$=20 to 40%:40 to 70%:5 to 25%, respectively, provided that $TMP_{mol\ \%}$ is assigned to the molar percentage of the component derived from trimethylolpropane, $FAP_{mol\ \%}$ is assigned to the molar percentage of the component derived from the straight-chain saturated fatty acid having a carbon number of 8 to 10, and $AD_{mol\ \%}$ is assigned to the molar percentage of the component derived from adipic acid.

In the case that $AD_{mol\ \%}$ is less than 5%, sufficiently high wear resistance or load-carrying capacity may not be obtained. In the case that $AD_{mol\ \%}$ exceeds 25 percent, the biodegradability may be deteriorated and the energy loss may be increased due to fluid loss. $AD_{mol\ \%}$ may preferably be 10 to 20 percent and more preferably be 11 to 19 percent.

Further, $TMP_{mol\ \%}$ may more preferably be 25 to 35 percent and $FA_{mol\ \%}$ may more preferably be 45 to 65 percent.

Further, it is provided that $TMP_{OH}$ represents the hydroxyl value of the ester compound (A), $FA_{COOH}$ represents the carboxyl group equivalent of the straight-chain saturated fatty acid having a carbon number of 8 to 10, and $AD_{COOH}$ represents the carboxylic acid equivalent of adipic acid, the ester compound (A) of the present invention may preferably satisfy the following condition.

$$(FA_{COOH}+AD_{COOH})/TMP_{OH}=0.85\sim1.05$$

It is possible to provide the ester having excellent biodegradability, excellent wear resistance upon blending the wear prevention agent and high oxidation stability, by satisfying the condition. $((FA_{COOH}+AD_{COOH})/TMP_{OH})$ may preferably be 0.87 to 1.04 and may more preferably be 0.89 to 1.03.

Further, $TMP_{mol\ \%}$, $FA_{mol\ \%}$, $AD_{mol\ \%}$, $FA_{COOH}$, $AD_{COOH}$ and $TMP_{OH}$ are values calculated, after the ester compound (A) is analyzed by $^1H$ NMR to obtain molar ratios of the components derived from the respective raw materials.

The measurement conditions of $^1H$ NMR are shown below.

(Measurement Conditions)

Analyzing apparatus: $^1H$ NMR

Solvent: Heavy chloroform $^1H$ NMR chart of the ester obtained according to the measurement conditions described above is analyzed so that the molar ratios can be obtained.

Specifically, the following four kinds of peaks are used.

Peak (I): 3.40~3.60 ppm

Hydrogen atom at a position of unreacted hydroxyl group of trimethylolpropane

Peak (II): 4.00~4.20 ppm

Hydrogen atoms at a position of reacted hydroxyl group of trimethylolpropane {a total of the peak (I) and peak (II) is six atoms}

Peak (III): 0.85~0.90 ppm

Hydrogen atoms (three atoms) connected to terminal carbon atoms of the straight-chain saturated fatty acid having a carbon number of 8 to 10 and hydrogen atoms (three atoms) connected to terminal carbon atoms of ethyl group connected to quaternary carbon of trimethylolpropane Peak (IV): 2.25~2.35 ppm Hydrogen atoms (four atoms) at a position of carbonyl group of adipic acid and hydrogen atoms (two atoms) at a position of carbonyl groups of caprylic acid and capric acid The integrated values of the four peaks described above were calculated as follows to obtain the respective molar ratios.

$$TMP_{mol}=\{\text{Integrated value of peak } (I)+\text{Integrated value of peak } (II)\}/6$$

$$FA_{mol}=\{\text{Integrated value of peak } (III)-(TMP_{mol}\times 3)\}/3$$

$$AD_{mol}=\{\text{Integrated value of peak } (IV)-(FA_{mol}\times 2)\}/4$$

$TMP_{mol\,\%}$, $FA_{mol\,\%}$, and $AD_{mol\,\%}$ are calculated as follows based on $TMP_{mol}$, $FA_{mol}$ and $AD_{mol\,\%}$, respectively.

$$TMP_{mol\,\%}=100\times TMP_{mol}/(TMP_{mol}+FA_{mol}+AD_{mol})$$

$$FA_{mol\,\%}=100\times FA_{mol}/(TMP_{mol}+FA_{mol}+AD_{mol})$$

$$AD_{mol\,\%}=100\times AD_{mol}/(TMP_{mol}+FA_{mol}+AD_{mol})$$

Further, the kinematic viscosity at 40° C. of the ester compound (A) may preferably be 50 to 350 m $m^2/s$. The kinematic viscosity at 40° C. of the ester compound (A) may be made 50 $mm^2/s$ or higher, so that the wear resistance and load-carrying capacity can be further improved. Further, the kinematic viscosity at 40° C. of the ester compound (A) may be made 350 $mm^2/s$ or lower, so that it is possible to prevent the reduction of biodegradability and to suppress the energy loss due to fluid loss. The kinematic viscosity at 40° C. of the ester compound (A) may preferably be 55 to 300 $mm^2/s$ and more preferably be 60 to 250 $mm^2/s$.

Further, the lubricating oil composition of the present invention contains the amine salt (B) of the acidic phosphoric ester represented by the following formula.

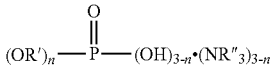

(n represents an integer of 1 or 2,

R' represents an alkyl group having a carbon number of 4 to 6, and

R" represents hydrogen atom or an alkyl group having a carbon number of 11 to 14.)

Here, R' represents an alkyl group having a carbon number of 4 to 6, which may be a straight-chain alkyl group or a branched-chain alkyl group. Each R" represents hydrogen atom or a straight-chain or branched-chain alkyl group having a carbon number of 11 to 14. At least one of three R" is preferably the straight-chain or branched-chain alkyl group having a carbon number of 11 to 14.

The amine salt (B) of the acidic phosphoric ester may have one or two hydroxyl group(s), as n represents an integer of 1 or 2. In the case that the number of hydroxyl group is one, two —OR' groups are included. In the case that two hydroxyl groups are included, the number of —OR' group is one. They may be used as a mixture.

R' represents a straight-chain or branched-chain alkyl group having a carbon number of 4 to 6. In the case that the carbon number of R' is less than 4, it may not be obtained sufficiently high wear resistance. Further in the case that the carbon number of R' exceeds 6, sufficiently high wear resistance may not be obtained. In the case that R' is a branched alkyl group, the branched alkyl group may be either of t-branched, sec-branched, iso-branched alkyl groups and the mixtures thereof. According to the present invention, it is most preferred monohexyl or dihexyl phosphate having a carbon number of 6, as excellent wear prevention performance can be obtained.

R" represents hydrogen atom or a straight-chain or branched chain alkyl group having a carbon number of 11 to 14. In the case that the carbon number of R" is less than 10, the solubility to the lubricant oil is lowered, resulting in the risk of generation of precipitation at a low temperature upon blending, which is not preferred. On the other hand, in the case that the carbon number of R" is 15 or higher, sufficiently high wear resistance may not be obtained. According to the present invention, preferably, R" is mainly composed of alkyl groups whose carbon numbers are 12 and 14.

According to the present invention, 0.05 to 1.5 mass parts of (B) the amine salt of the acidic phosphoric ester is contained with respect to 100 mass parts of (A) the ester compound. In the case that the content of (B) the amine salt of the acidic phosphoric ester is less than 0.05 mass parts, sufficiently high wear resistance may not be obtained. Further, In the case that the content of (B) the amine salt of an acidic phosphoric ester exceeds 1.5 mass parts, the biodegradability and oxidation stability may be deteriorated. The content of (B) the amine salt of the acidic phosphoric ester may preferably be 0.1 to 1.25 mass parts and more preferably be 0.15 to 1.00 mass parts.

Further, the lubricating oil composition of the present invention contains (C) the monoesterified compound of an alkane diol having a carbon number of 3 to 8 and of succinic acid having an alkyl group having a carbon number of 8 to 18 or an alkenyl group having a carbon number of 8 to 18. Succinic acid having the alkyl group having a carbon number of 8 to 18 or the alkenyl group having a carbon number of 8 to 18 is known as succinic acid derivative, in which the alkyl group having a carbon number of 8 to 18 or the alkenyl group having a carbon number of 8 to 18 is added to succinic acid. According to the present invention, in the case that it is used succinic acid having an alkyl group or alkenyl group having a carbon number less than 8 or a carbon number exceeding 18, sufficiently high rust-prevention performance may not be obtained. It is preferably used succinic acid having an alkyl group having a carbon number of 8 to 16 or an alkenyl group having a carbon number of 8 to 16, more preferably used succinic acid having an alkyl group having a carbon number of 10 to 14 or an alkenyl group having a carbon number of 10 to 14, and most preferably used dodecyl or dodecenyl succinic acid having dodecyl group or dodecenyl group having a carbon number of 12.

As the alkane diol having a carbon number of 3 to 8 to be reacted with succinic acid having the alkyl group having a carbon number of 8 to 18 or alkenyl group having a carbon number of 8 to 18, the alkane diol having a carbon number of 3 to 8 may be of straight-chain or branched chain. Further, the position of hydroxyl group is not particularly limited. As the alkane diol preferred in the present invention, the alkane diol having a carbon number of 3 to 6 is preferred, propane diol or butane diol having a carbon number of 3 or 4 is more preferred, and 1,2-propane diol is most preferred.

(C) The monoesterified compound of the present invention may be a monoesterified compound obtained by reacting an alkane diol having a carbon number of 3 to 8 with succinic acid having an alkyl group having a carbon number of 8 to 18 or an alkenyl group having a carbon number of 8 to 18. Alternatively, it may be a monoesterified compound obtained by reacting succinic acid with an alkane diol having a carbon number of 3 to 8 to obtain a monoester and then by adding an alkyl group having a carbon number of 8 to 18 or an alkenyl group having a carbon number of 8 to 18 to the monoester. In the case of using a diester, sufficiently high rust-prevention performance may not be obtained. It is possible to mix the diester compound in addition to the monoesterified compound.

According to the present invention, 0.01 to 0.50 mass parts of (C) the monoesterified compound is contained with respect to 100 mass parts of (A) the ester compound. In the case that the content of (C) monoesterified compound is less than 0.01 mass parts, sufficiently high rust-prevention performance may not be obtained. Further, in the case that the content of (C) monoesterified compound exceeds 0.50 mass parts, the oxidation stability of the lubricating oil composition may be deteriorated. On the viewpoint, the content of (C) monoesterified compound may preferably be 0.02 to 0.30 mass parts and more preferably be 0.05 to 0.20 mass parts, with respect to 100 mass parts of (A) the ester compound.

The lubricating oil composition of the present invention contains (A) the ester compound, (B) the amine salt of the acidic phosphoric ester and (C) monoesterified compound as described above in the contents as described above, respectively. It is thereby possible to obtain high biodegradability, excellent rust-prevention performance, high oxidation stability and high lubricating property (wear resistance).

Various kinds of additives conventionally used may be blended in the lubricating oil composition of (A) the ester compound, (B) the amine salt of the acidic phosphoric ester and (C) the monoesterified compound described above. Such additives to be blended includes an anti-oxidant, a metal deactivator, an antifoamer, a pour point decreasing agent, a viscosity index improver, a thickener, a detergent, an ashless dispersing agent or the like.

As the oxidation preventing agent, it may be used a phenol-based oxidation prevention agent, an amine-based oxidation prevention agent, a sulfur-based oxidation prevention agent or the like. The phenol-based oxidation prevention agent and amine-based oxidation prevention agent are more preferably used.

As the phenol-based oxidation prevention agent, it may be preferably used 2, 6-di-t-butyl-p-cresol, 4,4'-methylene bis-(2,6-di-t-butylphenol), 4,4'-thiobis(2-methyl-6-t-butylphenol), 4,4'-bis(2,6-di-t-butylphenol) or pentaerythritol tetrakis [3-(3,5-di-tert-butyl-4-hydroxyphenyl) propionate]. Pentaerythritol tetrakis[3-(3,5-di-tert-butyl-4-hydroxyphenyl) propionate] is more preferably used.

As the amine-based oxidation prevention agent, it may be preferably used phenyl-α-naphthylamine, phenyl-β-naphthylamine, alkylphenyl-α-naphthylamine, alkylphenyl-β-naphthylamine, bis(alkylphenyl)amine, phenothiazine, monooctyl diphenylamine, 4, 4'-bis(α,α-dimethylbenzyl) diphenyl amine-4,4'-dicumyldiphenyl amine, 2,2,4-trimethyl-1,2-dihydroquinoline or its polymerized product, 6-methoxy-2,2,4-trimethyl-1,2-dihydroquinoline or its polymerized product, and 6-ethoxy-2,2,4-trimethyl-1,2-dihydroquinoline or its polymerized product, for example. Among them, it may be more preferably used 4,4'-bis(α,α-dimethylbenzyl) diphenyl amine-4,4'-dicumyldiphenyl amine and 2,2,4-trimethyl-1,2-dihydroquinoline or its polymerized product.

Further, the phenol-based oxidation prevention agent and amine-based oxidation prevention agent may be used in combination, so that the oxidation stability of the lubricating oil of the present invention can be further improved.

The lubricating oil composition of the present invention can be produced by blending (A) the ester compound, (B) the amine salt of the acidic phosphoric ester and (C) the monoesterfied compound in predetermined blending ratios, respectively, while optionally various kinds of the additives described above are blended. The blending, mixing and adding methods of the respective additives are not particularly limited, and various methods may be applied. The order of the blending, mixing and adding are not particularly limited, and various kinds of methods may be applied. For example, it may be used the method of directly adding various kinds of additives to (A) the ester compound, which is then heated and mixed, or of preparing solution of a high concentration of the additive in advance and mixing the solution with (A) the ester compound.

EXAMPLES

The present invention will be described further in detail below, referring to inventive and comparative examples.

(Synthesis of Ester Compounds I to V)

Into a four-necked flask of 5 liters equipped with a thermometer, a tube of introducing nitrogen gas, an agitator and an air-cooling tube, predetermined amounts of trimethylolpropane (TMP), "NAA-82" supplied by NOF corporation (caprylic acid for industrial use having a content of caprylic acid of 99 percent), "NAA-102" (capric acid for industrial use having a content of capric acid of 99 percent) and adipic acid were charged. The mixture was reacted under nitrogen flow at 240° C. at ambient pressure while water generated during the reaction was evaporated, to obtain the ester compounds I to V.

(Synthesis of Ester Compound VI)

Predetermined amounts of trimethylolpropane (TMP), "NAA-34" supplied by NOF corporation (oleic acid for industrial use) and dimer acid were charged into a four-necked flask of 5 liters equipped with a thermometer, a tube for introducing nitrogen gas, an agitator and an air-cooling tube, and then reacted under nitrogen gas flow at 240° C. under ambient pressure, while water generated during the reaction was evaporated, to obtain the ester compound VI.

As to the ester compounds I to VI obtained as described above, the molar percentages of the respective raw materials were measured by $^1$H NMR and listed in table 1. Further, kinematic viscosities at 40° C. and at 100° C., flash point, acid value and viscosity index were measured and the results were shown in table 1.

TABLE 1

| | | Ester compound | | | | | |
|---|---|---|---|---|---|---|---|
| | | I | II | III | IV | V | VI |
| Molar percentage of component derived from raw material | trimethylolpropane | 29.7 | 29.7 | 28.3 | 31.7 | 28.4 | 29.9 |
| | Fatty acid mixture of caprylic and capric acids | 54.1 | 54.1 | 52.9 | 41.1 | 62.1 | — |
| | Adipic acid | 14.1 | 14.1 | 16.4 | 24.0 | 8.1 | — |

TABLE 1-continued

| | | Ester compound | | | | | |
|---|---|---|---|---|---|---|---|
| | | I | II | III | IV | V | VI |
| (mol %) | oleic acid | — | — | — | — | — | 2.0 |
| | dimer acid | — | — | — | — | — | 0.4 |
| | $(FA_{COOH} + AD_{COOH})/TMP_{OH}$ | 0.9 | 0.9 | 1.0 | 0.9 | 0.9 | — |
| Physical values | kinematic viscosity at 40° C. (mm2/s) | 102.3 | 110.9 | 156.3 | 410.0 | 44.6 | 140.6 |
| | kinematic viscosity at 100° C. (mm2/s) | 14.0 | 15.5 | 21.0 | 38.1 | 7.7 | 22.0 |
| | viscosity index | 139 | 148 | 158 | 139 | 140 | 184 |
| | Flash point (° C., COC法) | 280 | 282 | 286 | 290 | 258 | 290 |
| | acid value (mg KOH/g) | 0.5 | 0.6 | 1.8 | 0.8 | 0.2 | 2.2 |

Inventive Examples 1 to 6 and Comparative Examples 1 to 10

(Preparation of Lubricating Oil Composition)

Additives were blended into each of the ester compounds I to VI obtained as described above, according to the following procedure, to prepare lubricating oil compositions of the inventive examples 1 to 6 and comparative examples 1 to 10.

The following additives were added, in blending ratios described in tables 2 and 3, respectively, into each of the ester compounds 1 to VI synthesized as described above, in a four-necked flask of 5 liters equipped with a thermometer, a tube for introducing nitrogen gas, an agitator and a Dimroth condenser. The thus obtained mixture was reacted at 80° C. for 1 hour by performing mixing by agitation to obtain each of the lubricating oil compositions.

Further, the following additives were used.

(Wear Prevention Agent)

(B) mono.dihexyl phosphate.C11 to C14 branched alkyl amine salt (Reinchemie Ltd. "RC 3760")

(B) Branched butyl phosphate.C11 to C14 branched alkyl amine salt (Reinchemie Ltd. "RC 3740")

tridecyl acid phosphate.trioctylamine salt (Rust-Prevention Agent)

(C) Monoester of dodecenyl succinic acid and 1,2-propanediol (BASF corporation, "IRGACOR L12")

Dodecenyl succinic acid alkylimide (imidized product of dodecenyl succinic acid and dodecylamine)

N-oleoyl sarcosine

N-hydroxyethyl oleyl imidazoline (Oxidation Prevention Agent)

dibutyl hydroxytoluene (GHT)

(Metal Deactivator)

Benzotriazole derivative (BASF Corporation, "IRGAME T 39")

(Evaluation of Lubricating Oil Composition)

The thus prepared lubricating oil compositions were subjected to the following evaluation, and the results were described in tables 2 and 3.

(Biodegradability Test)

Biodegradability test was performed according to OECD 301C. In the case that the biodegradability measured by the test is 60 percent or higher, it is qualified standards as a biodegradable lubricant oil according to ECO MARK OFFICE of Public Interest Incorporated foundation "Japan Environment Association". According to this test, it is marked as "X" in the case that the biodegradability is below 60 percent, it is marked as "○" in the case that the biodegradability is 60 percent or higher and below 70 percent, and it is marked as "◎" in the case that the biodegradability is 70 percent or higher.

(Oxidation Stability: RPVOT Test)

It was performed rubricating oil oxidation stability test (RPVOT test) based on Japanese industrial standards JIS K2514-3 (2013). The numerical values described in the tables indicate time periods (minutes) required for the pressure to be lowered from the maximum pressure by 175 kPa. As the numerical value is larger, the oxidation stability is better.

(Wear Resistance: Shell Four-Ball Wear Test)

Using a high-speed Shell four-ball testing machine, wear scar diameter (μm) was measured according to ASTM D4172. As the wear scar diameter (μm) is smaller, the wear resistance is better.

(Rust-Prevention Performance Test)

The rust-prevention performance test (Artificial sea water) of the lubricant oils was performed according to Japanese Industrial Standards JIS K2510. Although the test is completed in 24 hours conventionally, the test was continued for 2 weeks and then the results of the prevention of rust are evaluated after the 2 weeks. According to the test, "○" is marked in the case that the rust is not observed, and "X" is marked in the case that the rust was observed.

TABLE 2

| | | | Inventive Examples | | | | | | Comparative Examples | |
|---|---|---|---|---|---|---|---|---|---|---|
| | | | 1 | 2 | 3 | 4 | 5 | 6 | 1 | 2 |
| base oil | ester compound | | I | I | II | III | IV | V | I | I |
| | (mass parts) | | 100 | 100 | 100 | 100 | 100 | 100 | 100 | 100 |
| Additives (mass parts) | Wear prevention agent | (B) mono•dihexyl phosphate•C11-14 branched alkyl amine salt | 0.5 | 0 | 0.3 | 0 | 0.5 | 0.5 | 0 | 0 |
| | | (B) Branched butyl phosphate•C11 to C14 branched alkyl amine salt | 0 | 0.5 | 0 | 1.0 | 0 | 0 | 0 | 0 |
| | | tridecyl acid phosphate•trioctylamine salt | 0 | 0 | 0 | 0 | 0 | 0 | 0 | 0.5 |
| | Rust-prevention agent | (C) Monoester of dodecenyl succinic acid and 1,2-propanediol | 0.15 | 0.15 | 0.15 | 0.10 | 0.15 | 0.15 | 0.15 | 0.15 |

TABLE 2-continued

| | | | Inventive Examples | | | | | | Comparative Examples | |
|---|---|---|---|---|---|---|---|---|---|---|
| | | | 1 | 2 | 3 | 4 | 5 | 6 | 1 | 2 |
| | | Dodecenyl succinic acid alkylimide | 0 | 0 | 0 | 0 | 0 | 0 | 0 | 0 |
| | | N-oleoyl sarcosine | 0 | 0 | 0 | 0 | 0 | 0 | 0 | 0 |
| | | N-β-hydroxyethyl oleyl imidazoline | 0 | 0 | 0 | 0 | 0 | 0 | 0 | 0 |
| | Oxidation prevention agent | dibutyl hydroxytoluene (BHT) | 0.5 | 0.5 | 0.5 | 0.5 | 0.5 | 0.5 | 0.5 | 0.5 |
| | Metal deactivator | Benzotriazole derivative | 0.05 | 0.05 | 0.05 | 0.05 | 0.05 | 0.05 | 0.05 | 0.05 |
| Performance | Biodegradability test | | ◎ | ◎ | ◎ | ◎ | ○ | ◎ | ◎ | ◎ |
| | Oxidation stability (RPVOT) (min.) | | 247 | 251 | 218 | 350 | 265 | 218 | 240 | 235 |
| | Wear resistance (Wear scar diameter) (μm) | | 311 | 359 | 362 | 298 | 305 | 415 | 688 | 574 |
| | Rust-prevention performance (Artificial sea water: Presence or absence of rust after 2 weeks) | | None | None | None | None | None | None | None | None |

TABLE 3

| | | | Comparative Examples | | | | | | | |
|---|---|---|---|---|---|---|---|---|---|---|
| | | | 3 | 4 | 5 | 6 | 7 | 8 | 9 | 10 |
| base oil | ester compound | | II | II | II | III | III | III | IV | VI |
| | (mass parts) | | 100 | 100 | 100 | 100 | 100 | 100 | 100 | 100 |
| Additives (mass parts) | Wear prevention agent | (B) mono•dihexyl phosphate•C11-14 branched alkyl amine salt | 0 | 0 | 0 | 0 | 0 | 0 | 0 | 0.5 |
| | | (B) Branched butyl phosphate•C11 to C14 branched alkyl amine salt | 0.5 | 0.5 | 0.5 | 0 | 5.0 | 1.0 | 5.0 | 0 |
| | | tridecyl acid phosphate•trioctylamine salt | 0 | 0 | 0 | 1.0 | 0 | 0 | 0 | 0 |
| | Rust-prevention agent | (C) Monoester of dodecenyl succinic acid and 1,2-propanediol | 0 | 0 | 0 | 0 | 0.15 | 3.0 | 3.0 | 0.15 |
| | | Monoester of dodecenylsuccinic acid and lauric acid | 0.15 | 0 | 0 | 0 | 0 | 0 | 0 | 0 |
| | | Dodecenyl succinic acid alkylimide | 0 | 0.15 | 0 | 0 | 0 | 0 | 0 | 0 |
| | | N-oleoyl sarcosine | 0 | 0 | 0.15 | 0 | 0 | 0 | 0 | 0 |
| | | N-β-hydroxyethyl oleyl imidazoline | 0 | 0 | 0 | 0.15 | 0 | 0 | 0 | 0 |
| | Oxidation prevention agent | dibutyl hydroxytoluene (BHT) | 0.5 | 0.5 | 0.5 | 0.5 | 0.5 | 0.5 | 0.5 | 0.5 |
| | Metal deactivator | Benzotriazole derivative | 0.05 | 0.05 | 0.05 | 0.05 | 0.05 | 0.05 | 0.05 | 0.05 |
| Performance | Biodegradability test | | ◎ | ◎ | ◎ | ◎ | ○ | ○ | X | ◎ |
| | Oxidation stability (RPVOT) (min.) | | 222 | 256 | 245 | 232 | 110 | 248 | 249 | 38 |
| | Wear resistance (Wear scar diameter) (μm) | | 370 | 361 | 353 | 692 | 315 | 510 | 545 | 298 |
| | Rust-prevention performance (Artificial sea water: Presence or absence of rust after 2 weeks) | | Present | Present | Present | Present | Absent | Absent | Absent | Present |

As described in the inventive examples 1 to 6 shown in table 2, it is proved that the lubricating oil composition of the present invention is excellent in biodegradability, rust-prevention performance against sea water, oxidation stability and lubricating property (wear resistance) upon adding various kinds of the additives.

According to the comparative example 1, as (B) the amine salt of the acidic phosphoric ester is not contained, the wear resistance of the lubricating oil composition is low.

According to the comparative example 2, (B) the amine salt of the acidic phosphoric acid ester is not contained and instead tridecyl acid phosphate.trioctylamine salt is contained. As a result, the wear resistance of the lubricating oil composition is low.

According to the comparative examples 3 to 6, (C) the monoesterified compound is not contained and the other components listed in table 3 are contained. As a result, the rust-prevention performance of each of the lubricating oil compositions is low and rust is generated.

According to the comparative example 7, the content of (B) the amine salt of the acidic phosphoric ester is high, and the oxidation stability of the lubricating oil composition is low.

According to the comparative example 8, the content of (C) monoesterified compound is high, and the wear resistance of the lubricating oil composition is low.

According to the comparative example 9, the contents of (B) the amine salt of the acidic phosphoric acid ester and (C) the monoesterified compound are high, and the wear resistance and biodegradability of the lubricating oil composition are low.

According to the comparative example 10, caprylic acid, capric acid and adipic acid are not blended and instead oleic acid and dimer acid are blended into the ester compound VI, the oxidation stability and rust-prevention performance of the lubricating oil composition are low.

Inventive Examples 7, 8 and 9

In the lubricating oil composition of the inventive example 1, as shown in table 4, only the oxidation prevention agent was changed to obtain each of the lubricating oil compositions of the inventive examples 7, 8 and 9. However, as shown in table 4, in the inventive examples 7, 8 and 9, a phenol-based oxidation prevention agent (pentaerythritol tetrakis[3-(3,5-di-tert-butyl-4-hydroxypheny)-propionate]) was used. In the inventive examples 8 and 9, it was further used an amine-based oxidation prevention agent (4,4'-bis(α,α-dimethyl benzyl) diphenylamine-4,4'-dicumyl diphenyl amine or polymerized product of 2,2,4-trimethyl-1,2-dihydroquinoline). It was then performed measurements as the inventive examples 1 to 6, and the results are shown in table 4.

TABLE 4

| | | | Inventive Examples | | |
|---|---|---|---|---|---|
| | | | 7 | 8 | 9 |
| base oil | ester compound | | I | I | I |
| | (mass parts) | | 100 | 100 | 100 |
| Additives (mass parts) | Wear prevention agent | (B) mono•dihexyl phosphate•C11-14 branched alkyl amine salt | 0.5 | 0.5 | 0.5 |
| | | (B) Branched butyl phosphate•C11 to C14 branched alkyl amine salt | 0 | 0 | 0 |
| | | tridecyl acid phosphate•trioctylamine salt | 0 | 0 | 0 |
| | Rust-prevention agent | (C) Monoester of dodecenyl succinic acid and 1,2-propanediol | 0.15 | 0.15 | 0.15 |
| | | Dodecenyl succinic acid alkylimide | 0 | 0 | 0 |
| | | N-oleoyl sarcosine | 0 | 0 | 0 |
| | | N-β-hydroxyethyl oleyl imidazoline | 0 | 0 | 0 |
| | Oxidation prevention agent | pentaerythritol tetrakis [3-(3,5-di-tert-butyl-4-hydroxypheny)-propionate]) | 0.5 | 0.5 | 0.5 |
| | | (4,4'-bis(α,α-dimethyl benzyl) diphenylamine-4,4'-dicumyl diphenyl amine | 0 | 1 | 0 |
| | | polymerized product of 2,2,4-trimethyl-1,2-dihydroquinoline | 0 | 0 | 1 |
| | Metal deactivator | Benzotriazole derivative | 0.05 | 0.05 | 0.05 |
| Performance | Oxidation stability (RPVOT) (min.) | | ◎ | ◎ | ◎ |
| | Oxidation stability (RPVOT)(min.) | | 252 | 1140 | 995 |
| | Wear resistance: (Wear scar diameter)(μm) | | 308 | 325 | 318 |
| | Rust-prevention performance (Artificial sea water: Presence or absence of rust after 2 weeks) | | Present | Present | Present |

Further, as shown in table 4, the lubricating oil compositions of the inventive examples 7, 8 and 9 are excellent in biodegradability, rust-prevention performance against sea water, oxidation stability and lubricating property (wear resistance). In addition to this, it is proved that the oxidation stability of the lubricating oil composition of the present invention can be further improved by using the phenol-based oxidation prevention agent and amine-based oxidation prevention agent in combination,

INDUSTRIAL APPLICABILITY

The lubricating oil composition of the present invention is excellent in biodegradability, rust-prevention performance against sea water, oxidation stability and lubricating property (wear resistance), and may be preferably used for a bearing oil, hydraulic oil, gear oil or the like used in ocean-surrounding regions. It is thereby possible to reduce the load onto environment even in the case that the composition is leaked out, to maintain sufficiently high rust-prevention performance and to prevent failure of an apparatus in the case that the composition is contaminated with sea water.

The invention claimed is:

1. A biodegradable lubricating oil composition biodegradable in a river or ocean comprising:

100 mass parts of (A) an ester compound described below;

0.05 to 1.5 mass parts of (B) an amine salt of an acidic phosphoric ester described below; and 0.01 to 0.50 mass parts of (C) a monoesterified compound described below, wherein:

(A) said ester compound of trimethylolpropane, a straight-chain saturated fatty acid having a carbon number of 8 to 10 and adipic acid, said ester compound satisfying the relationship of $TMP_{mol\ \%}$:$FA_{mol\ \%}$:$AD_{mol\ \%}$ of 20 to 40%:40 to 70%:5 to 25%, respectively, provided that $TMP_{mol\ \%}$ represents a molar percentage of a component derived from trimethylolpropane, $FA_{mol\ \%}$ represents a molar percentage of a component derived from said straight-chain saturated fatty acid having a carbon number of 8 to 10, and $AD_{mol\ \%}$ represents a molar percentage of adipic acid;

(B) said amine salt of said acidic phosphoric ester represented by the following formula (1):

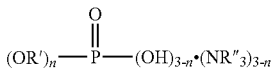

(1)

wherein n represents an integer of 1 or 2,

R' represents an alkyl group having a carbon number of 4 to 6, and

R" represents a hydrogen atom or an alkyl group having a carbon number of 11 to 14; and (C) said monoesterified compound of an alkane diol having a carbon number of 3 to 8 and of succinic acid having an alkyl group having a carbon number of 8 to 18 or an alkenyl group having a carbon number of 8 to 18.

2. The biodegradable lubricating oil composition according to claim 1, which is used in an environment susceptible to leakage into a river or ocean.

3. The biodegradable lubricating oil composition according to claim 1, which is a rust prevention lubricant oil composition with rust-prevention property against sea water.

4. The biodegradable lubricating oil composition according to claim 2, which is a rust prevention lubricant oil composition with rust-prevention property against sea water.

5. A 2-cycle engine oil composition in an outboard motor for use in a lake region, said engine oil composition comprising the biodegradable lubricating oil composition according to claim 1.

6. A 2-cycle engine oil composition in an outboard motor for use in a lake region, said engine oil composition comprising the biodegradable lubricating oil composition according to claim 2.

7. A hydraulic oil composition for a construction machinery near a river, said hydraulic oil composition comprising the biodegradable lubricating oil composition according to claim 1.

8. A hydraulic oil composition for a construction machinery near a river, said hydraulic oil composition comprising the biodegradable lubricating oil composition according to claim 2.

9. A lubricant oil composition in a wetted part of a ship, said lubricant oil composition comprising the biodegradable lubricating oil composition according to claim 1.

10. A lubricant oil composition in a wetted part of a ship, said lubricant oil composition comprising the biodegradable lubricating oil composition according to claim 2.

11. A stern bearing oil for a ship, said stern bearing oil comprising the biodegradable lubricating oil composition according to claim 1.

12. A stern bearing oil for a ship, said stern bearing oil comprising the biodegradable lubricating oil composition according to claim 2.

* * * * *